US008407945B2

(12) United States Patent
Kelly

(10) Patent No.: US 8,407,945 B2
(45) Date of Patent: Apr. 2, 2013

(54) SPRING FLANGE FOR ROOFING SYSTEMS

(76) Inventor: Thomas L. Kelly, Waterbury, CT (US)

( * ) Notice: Subject to any disclaimer, the term of this patent is extended or adjusted under 35 U.S.C. 154(b) by 466 days.

(21) Appl. No.: 12/277,520

(22) Filed: Nov. 25, 2008

(65) Prior Publication Data

US 2010/0126096 A1 May 27, 2010

(51) Int. Cl.
*E04D 1/36* (2006.01)
*E04D 15/00* (2006.01)
*E04H 12/00* (2006.01)

(52) U.S. Cl. ..... 52/58; 52/97; 52/300

(58) Field of Classification Search ..... 52/58, 60, 52/94, 96, 97, 287.1, 288.1, 222, 61, 62, 52/300, 349

See application file for complete search history.

(56) References Cited

U.S. PATENT DOCUMENTS 1,740,753 A * 12/1929 Vallas ..... 52/58
3,237,352 A * 3/1966 Edwards ..... 52/60
3,277,618 A * 10/1966 Smith ..... 52/58
3,608,255 A * 9/1971 Chomes ..... 52/61
3,979,860 A * 9/1976 Roth et al. ..... 52/61
4,156,993 A * 6/1979 Sorrells, Jr. ..... 52/60
4,190,989 A * 3/1980 Sakharoff ..... 52/60
5,123,208 A * 6/1992 Kirby et al. ..... 52/58
5,605,020 A * 2/1997 Chambers ..... 52/58
6,006,482 A * 12/1999 Kelly ..... 52/409
6,108,981 A * 8/2000 Sama et al. ..... 52/60
6,167,660 B1 * 1/2001 Sama ..... 52/58
7,594,369 B2 * 9/2009 Kelly ..... 52/302.3
2002/0178671 A1 * 12/2002 Gembala ..... 52/302.6
2009/0000239 A1 * 1/2009 Hamlin, III ..... 52/741.4

* cited by examiner

*Primary Examiner* — Joshua J Michener
*Assistant Examiner* — Ryan Kwiecinski
(74) *Attorney, Agent, or Firm* — Cantor Colburn LLP

(57) ABSTRACT

Disclosed is a spring flange termination system including a spring flange member of a resilient material, the member including an anchoring portion and a biasing portion, a first roof component anchored to the anchoring portion, a second roof component proximate the first component, and moveable in relation to the first component, and a roofing membrane including a first membrane portion and second membrane portion, the first membrane portion being anchored to the first component and the second membrane portion being loose laid over the first component or the second component, wherein the first membrane portion is disposed between the member and the first component such that the anchoring portion of the member anchors the first membrane portion to the first component, and wherein the biasing portion is configured to create a bias on second membrane portion towards at least one of the first component and the second component.

14 Claims, 14 Drawing Sheets

SPRING FLANGE FOR ROOFING SYSTEMS

FIELD OF THE INVENTION

The disclosure relates generally to a spring flange, and more particularly to a spring flange for roofing systems.

BACKGROUND

In roofing, wherever a horizontal roof meets a perimeter or penetration, the horizontal roof deck plane is interrupted by a vertical wall intersection. In this intersecting area between the deck and the wall, a roofing membrane is typically attached mechanically to the horizontal deck, where it is terminated at an angle change via horizontal wood nailers. Termination may also occur via fasteners and washers (or with a continuous bar) that are secured to the vertical wall at above the angle change. The roof field waterproofing membrane is fastened with screws and washers, nails, or continuously barred with a termination bar, at this area to fix the field membrane firmly in the angle change. A separate piece of membrane called "flashing" is installed down the vertical wall over the termination area, where it extends out onto the horizontal roof so as to waterproof the angle change termination. This flashing is sometimes installed in multiple layers to give additional strength for the movement that takes place in this angle change area.

As is known in the art, horizontal roof decks expand and contract (due to natural forces on the roof) in the horizontal plane, while the vertical walls they intersect, such as the vertical walls discussed above, expand in the vertical plane. Building expansion and contraction in the intersection area can cause both horizontally and vertically disposed roof membranes to experience horizontal and vertical movement that can tear the membranes from their attachments at the angle change. The stresses caused by movements of the horizontal and vertical components of the roof can cause splits, tears, wrinkles, and fish mouths in the roof membranes disposed at the intersection of these components. In addition, sunlight, wind, ice damming, and water flow can compound the issue of expansion in this roof area. Accordingly, a system or device that provides protection from weather elements while accommodating expansion or contraction stresses would be desirable.

SUMMARY OF THE INVENTION

Disclosed is a spring flange termination system including a spring flange member of a resilient material, the spring flange member including an anchoring portion and a biasing portion, a first roof component to which the anchoring portion of the spring flange member is anchored, a second roof component proximate the first roof component, the second roof component being moveable in relation to the first roof component, and a roofing membrane including a first membrane portion and second membrane portion, the first membrane portion being anchored to the first roof component and the second membrane portion being loose laid over at least one of the first roof component and the second roof component, wherein the first membrane portion is disposed between the spring flange member and the first roof component such that the anchoring portion of the spring flange member anchors the first membrane portion to the first roof component, and wherein the biasing portion of the spring flange member is configured to create a bias that presses the second membrane portion towards contact with at least one of the first roof component and the second roof component.

Also disclosed is a spring flange including a flange body member comprising a resilient material, an anchoring portion configured to anchor the spring flange and a roofing membrane to a first roof component, and a biasing portion configured to create a bias that presses the roofing membrane towards non-permanent contact with at least one of the first roof component and a second roof component.

Further disclosed is a spring flange air seal system including a spring flange member including an anchoring portion and a biasing portion, and comprising a resilient material, a first roof component to which the anchoring portion of the spring flange member is anchored, a second roof component proximate the first roof component, the second roof component being moveable in relation to the first roof component, wherein the second roof component comprises a non-fastenable material, and a sealing material disposed between the second roof component and the biasing portion of the spring flange member, the biasing portion being configured to create a bias that presses the sealing material into contact with the second roof component.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

Figure 1:
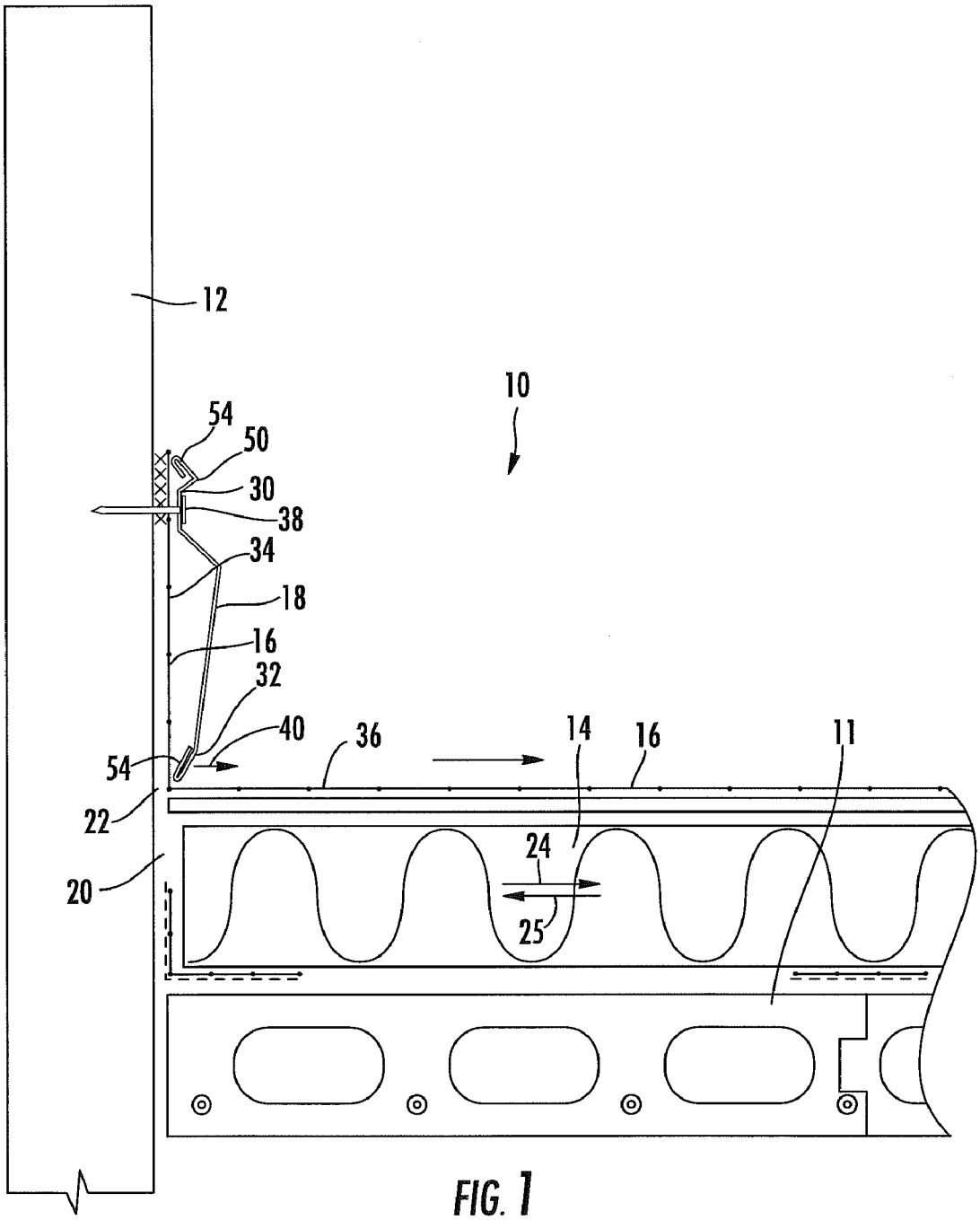
FIG. 1 is an elevated cross-sectional schematic of an embodiment of a spring flange roofing termination system.

Referring to FIGS. 1-16, a spring flange roofing termination system 10 for a roof deck 11 is illustrated. The system 10 includes a first roof component 12, a second roof component 14, at least one roofing membrane 16 (which is a reinforced membrane in an exemplary embodiment), and resilient flange member 18. The system 10, as well as these and other system components, will now be discussed in detail hereinbelow.

Figures 2, 4, 5:
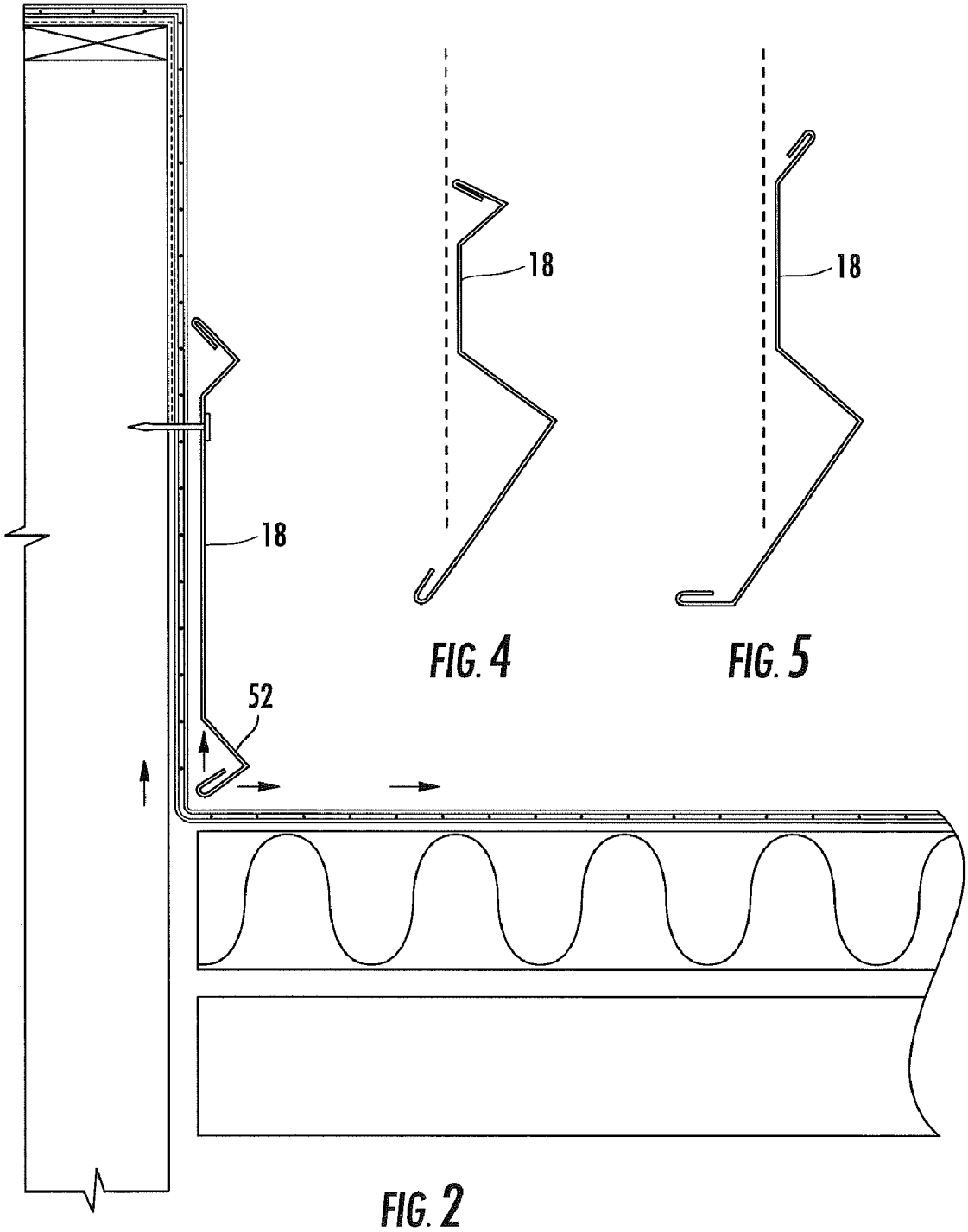
FIG. 2 is an elevated cross-sectional schematic of an embodiment of the spring flange roofing termination system of FIG. 1, showing another embodiment of a member.
FIG. 4 is an elevated cross-sectional schematic of another embodiment of a member.
FIG. 5 is an elevated cross-sectional schematic of another embodiment of a member.
Figure 3:
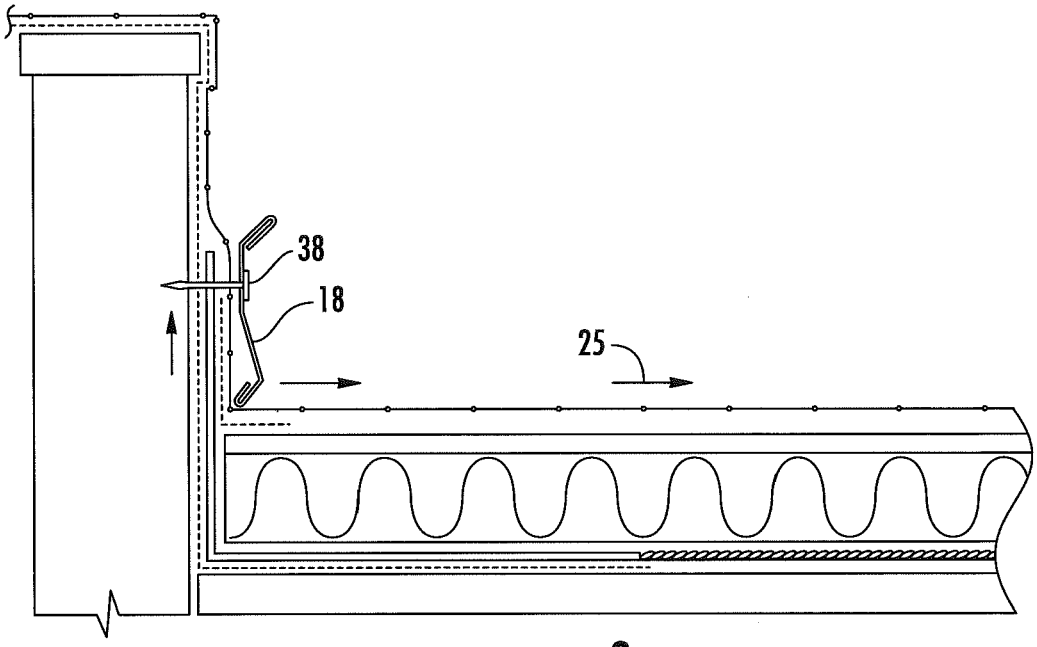
FIG. 3 is an elevated cross-sectional schematic of an embodiment of the spring flange roofing termination system of FIG. 1, showing another embodiment of a member.

Referring first to FIGS. 1-3 in particular, the first roof component 12 is a vertical wall like that which may be found around a perimeter of a roof (relevant portion of which being shown in the Figures). The second roof component 14 is a roof assembly that abuts the first component 12 at an area of intersection 20. In FIGS. 1-3, the area of intersection 20 includes an area of angle change 22. It should be noted that though the angle change 22 of FIGS. 1-3 is shown to be about 90-degrees, an angle change at the area of intersection 20 may include any angle useful in a roofing design, including no angle change at all. Exemplary embodiments including differing angle changes will be discussed later in the disclosure.

As is represented by arrows 24 and 25, the roofing assembly naturally expands and contracts during its lifetime, causing the second component 14 to move in opposing horizontal directions. Thus, during the lifetime of a roof, the second, horizontal component 14 moves relative to the first vertical component 12. The resilient flange member 18 addresses this relative movement, and the effect of the movement on the roofing membrane 16.

As is shown in FIGS. 1-3, resilient flange member 18 includes an anchoring portion 30 and a biasing portion 32, and the roofing membrane 16 includes a first membrane portion 34 and second membrane portion 36. The member 18 is anchored to the membrane 16 and vertical component 12 via a mechanical fastener 38 at the anchoring portion 30. This fastener 38 also secures the first membrane portion of the membrane 16 to the vertical component 12, with at least a portion of the first membrane portion 34 being disposed between the anchoring portion 30 and the vertical component 12. At the opposite end of the member 18, the biasing portion 32 biases the membrane 16 towards (and possibly into) non-permanent contact with the vertical component 12. In the exemplary embodiment of FIGS. 1-3, the biasing portion 32 contacts the membrane 16 at a junction between the first membrane portion 34 and second membrane portion 36, and biases the membrane 16 towards the area of angle change 22 between the vertical component 12 and horizontal component 14.

Figure 1A:
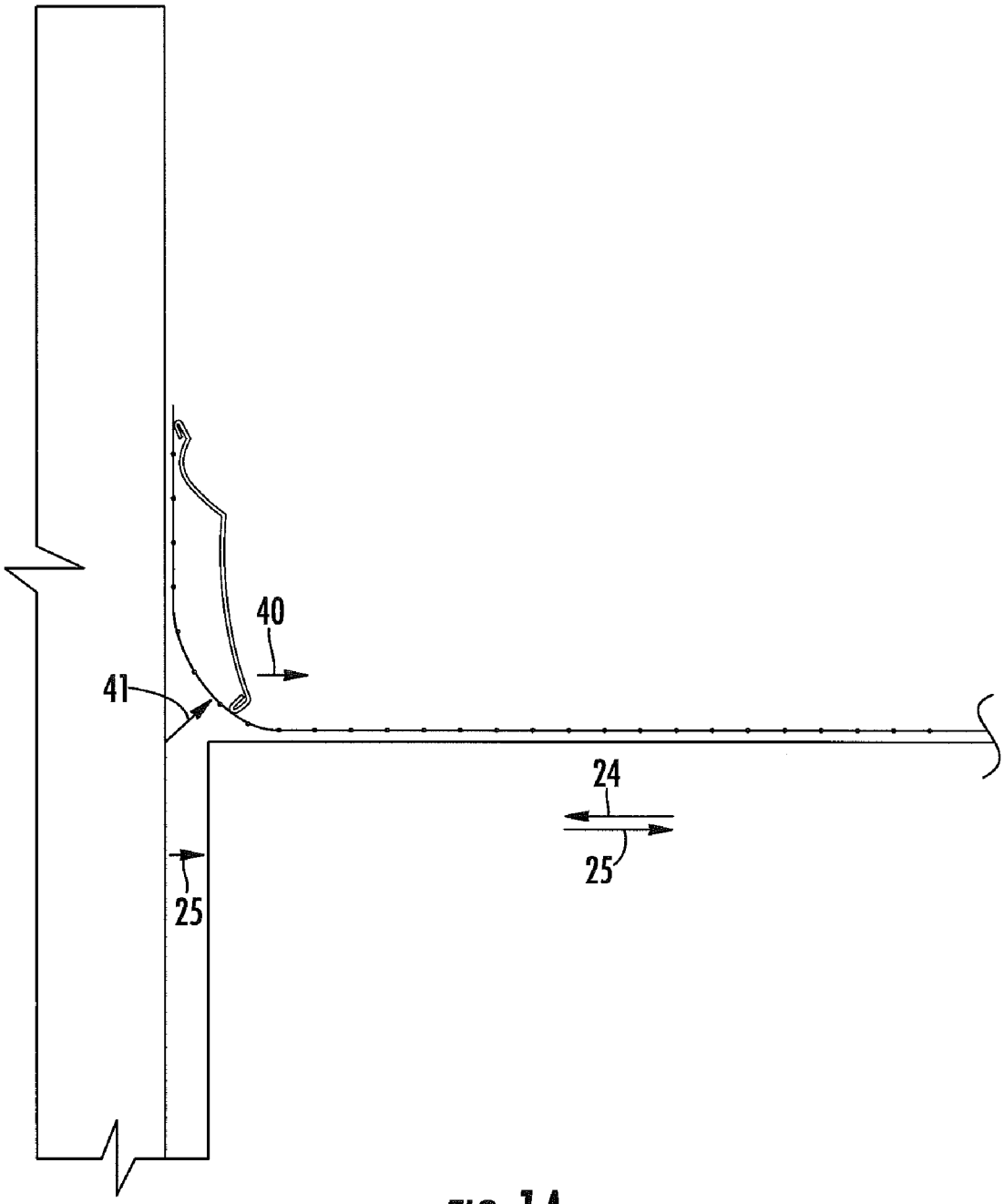
FIG. 1*a* is an elevated cross-sectional schematic of an embodiment of the spring flange roofing termination system of FIG. 1, showing movement.

By biasing the membrane 16 towards contact with the vertical component 12 without actually fixing the membrane 16 to the vertical component at the biasing portion 32 of the member 18, the member 18 allows the membrane 16 to move a reasonable distance (such as that represented by arrow 41) away from the vertical component 12 without tearing. As is in FIG. 1*a*, when the horizontal component 14, and second membrane portion 36 attached thereto, move in a direction away (see arrow 25) from the vertical component 14, the membrane 16 moves the member 18 away (see arrow 40) from the vertical component 12 at the point of contact between the membrane 16 and the biasing portion 32. Though movement of the membrane 16 away from the vertical component 12 overcomes the biasing of the biasing portion's bias of the membrane towards the vertical component 12, the biasing portion 32 continues to keep the membrane in relative proximity to the vertical and horizontal components 12 and 14 (see FIG. 1*a*).

It should be appreciated that the member 18 consists of a resilient material such as but not limited to sheet metal, polymer coated sheet metal, or plastic, and may include a first stiffening bend 50 at an end of the member 18 proximate the portion 30. The member 18 may also include a second stiffening bend 52 at an end of the member 18 proximate the biasing portion 32. In addition, the opposing ends of the member may also include hemmed, rounded, or curled terminations 54, which reduce any likelihood of tearing at points of contact with the membrane 16. The member 18 may further be configured various bends and configurations between the ends of the member 18, as shown in FIGS. 1-5, and the Figures of the embodiments to be discussed hereinbelow. It should be further appreciated that, in an exemplary embodiment of the system 10, the anchoring point (i.e. the point of the fastener 38) is disposed between three and eight inches above horizontal roof component 14.

Figure 6:
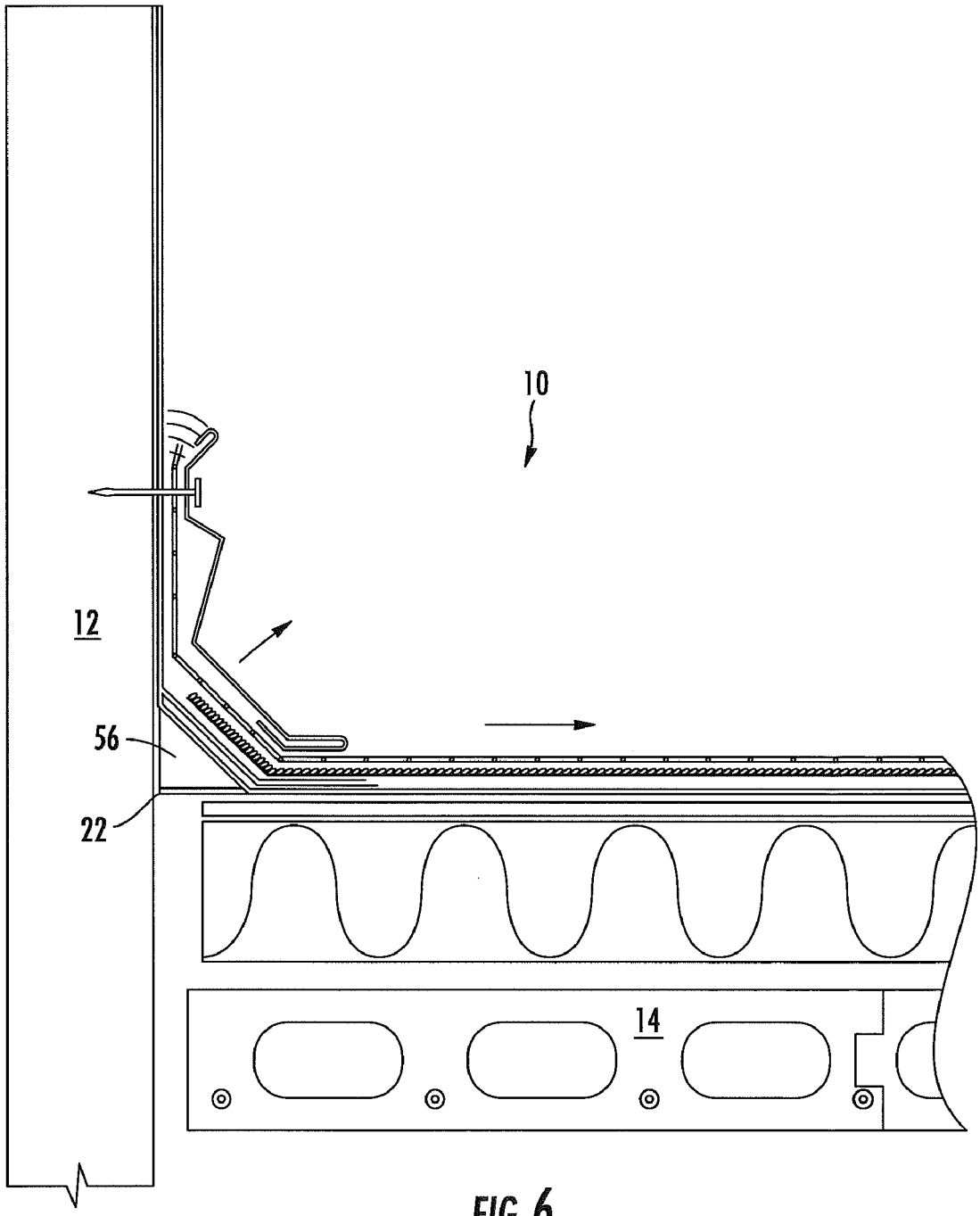
FIG. 6 is an elevated cross-sectional schematic of another embodiment of a spring flange roofing termination system.

Referring now to FIG. 6, another embodiment of the system 10 is illustrated. In this embodiment, the system includes a triangular filling structure 56 that is disposed at the area of angle change 22 between the first and second roof components 12 and 14.

Figure 7:
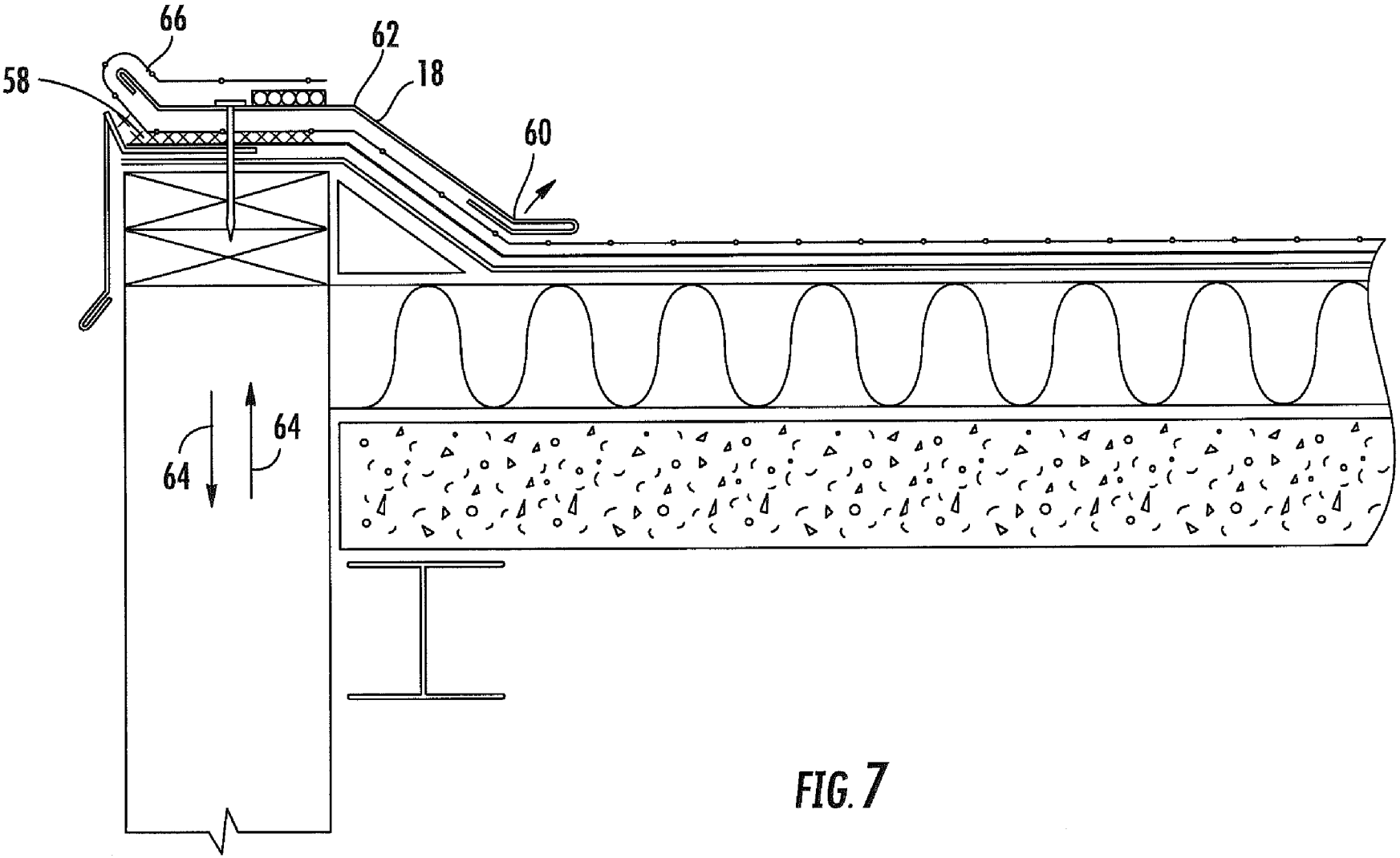
FIG. 7 is an elevated cross-sectional schematic of another embodiment of a spring flange roofing termination system.
Figure 8:
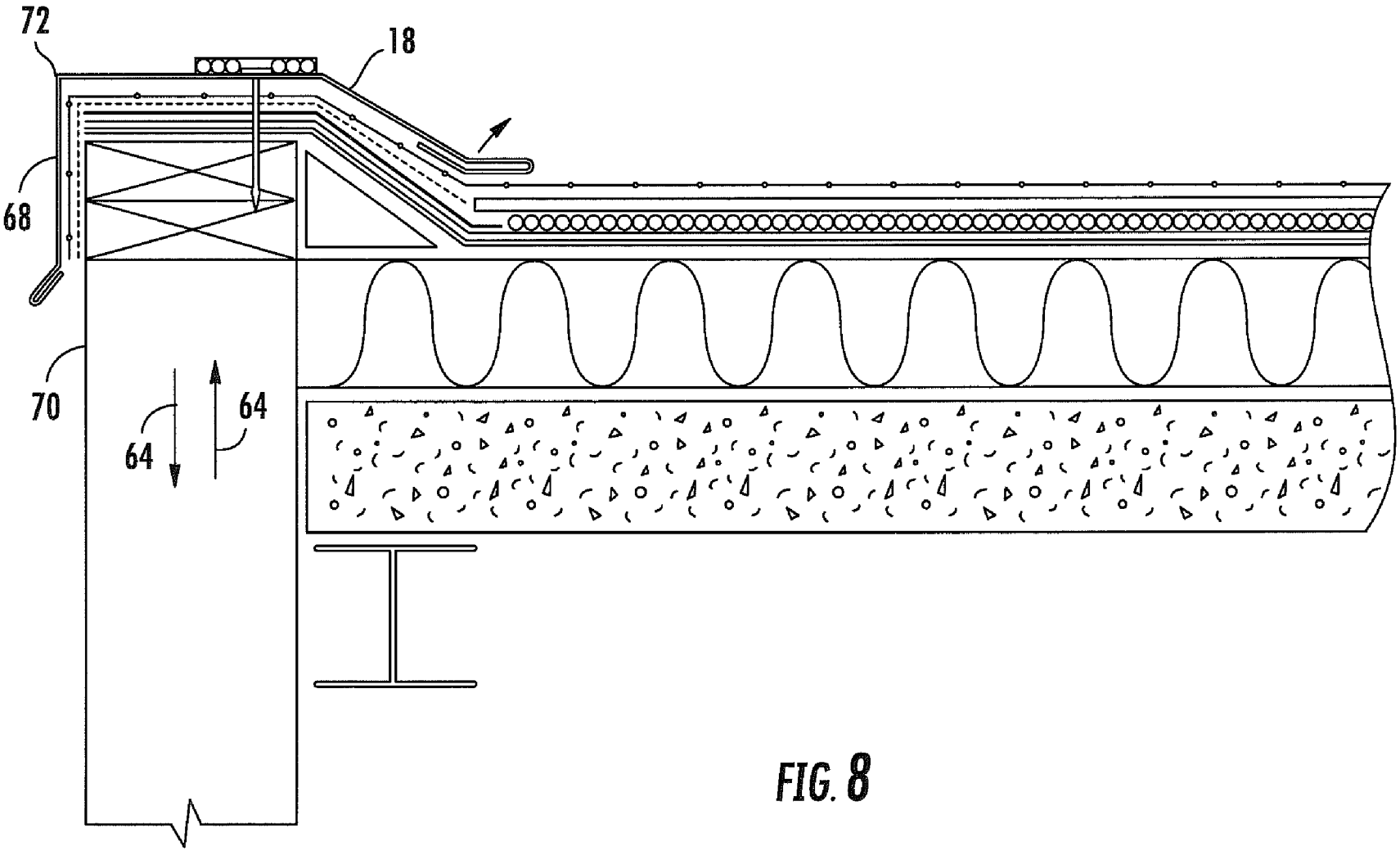
FIG. 8 is an elevated cross-sectional schematic of another embodiment of a spring flange roofing termination system.

Referring now to the exemplary embodiment of FIGS. 7 and 8, the member 18 is shown and configured to for adjacency with a relative top surface 58 of the vertical component 12. In the embodiment of these Figures, starting from a relative bottom of the member 18, the member 18 extends from an area of contact with the second membrane portion 36 (the area of contact being at the biasing portion 32 along the horizontal component 14) towards a relatively higher horizontal plane of the top surface 58 via a bend 60 in the member 18, which corresponds to the triangular filling structure 56 in this embodiment. The member 18 then flattens out for adjacency with the surface 58 via a second bend 62. In both FIGS. 7 and 8, the anchoring portion 30 and fastener 38 are disposed such that the fastener 38 fixes the member 18 to the upper surface 58.

By anchoring the member 18 to the system 10 at the upper surface 58, and disposing the non-fixed biasing portion 32 at the second membrane portion 36, the vertical component 12 is allowed to move in the direction of the arrows 64 without causing a tear at the second membrane portion 36. This ability to move without tearing is achieved via the biasing portion's ability to flex upward when the vertical component 12 moves down, as well as the biasing portion's ability to separate from the horizontal component 14 when the vertical component moves up (of course, when the biasing portion 32 separates, the second membrane portion 36 will separate with the biasing portion 32).

It should also be appreciated that, as shown in FIG. 7, a portion of the membrane 16 (such as the first membrane portion 34) may include a folded back portion 66 that is folded back upon itself over at least a portion of the member 18 (such as the anchoring portion 30). As is also shown in FIG. 7, this folded back portion 66 may also be adhered to an upper surface of the member 18. Furthermore as shown in FIG. 8, the member 18 may include an outer portion 68 that extends down an outer surface 70 of the vertical component 12 via a third bend 72 in the member 18. Of course, the fastener 38 may also be disposed at the outer portion 68.

Figure 9:
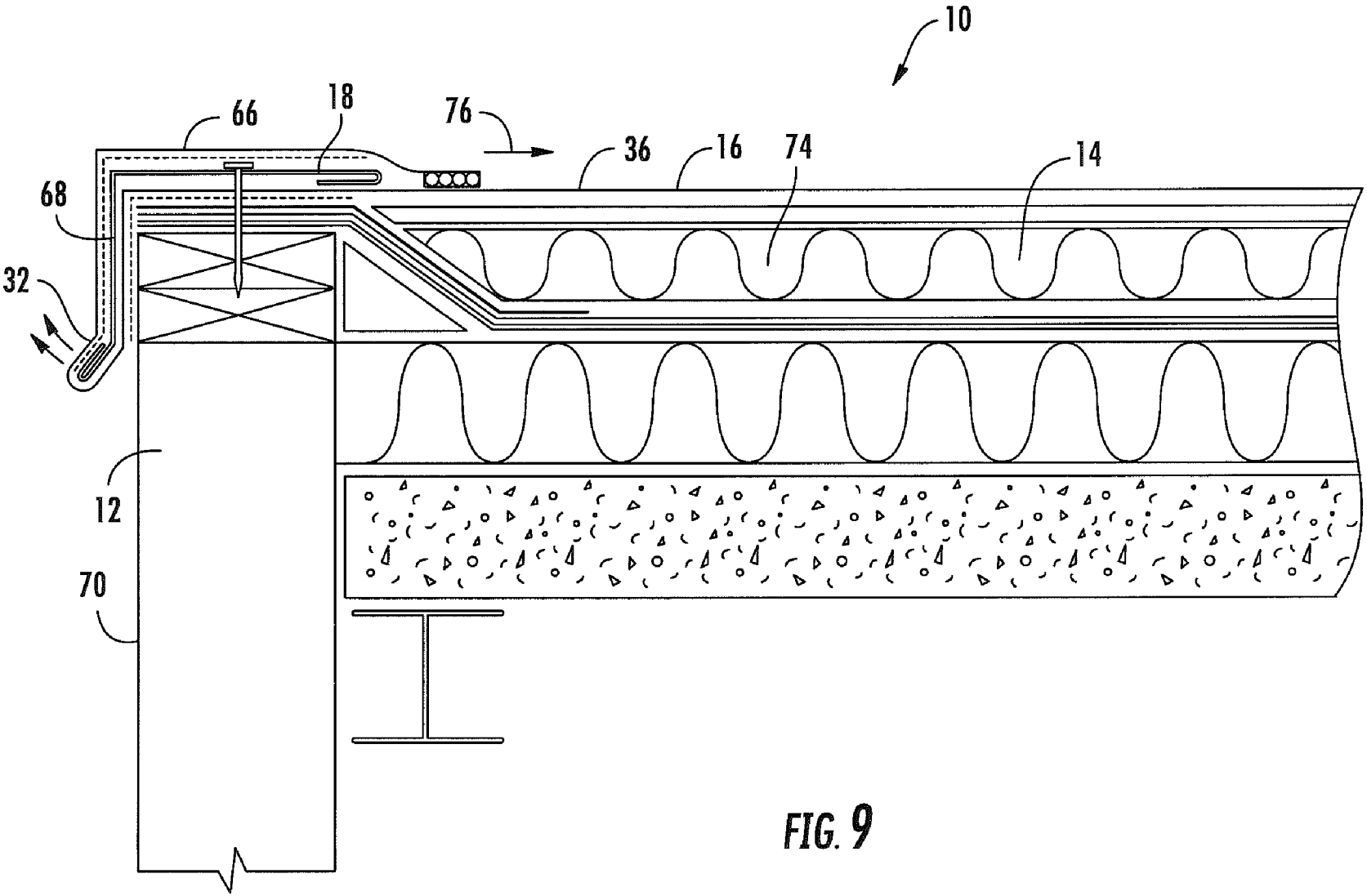
FIG. 9 is an elevated cross-sectional schematic of another embodiment of a spring flange roofing termination system.

Referring to FIG. 9, another exemplary embodiment of the system 10 is shown. In this embodiment, additional roofing structure 74 (which is part of the horizontal component 14) is laid atop the horizontal component 14, such that there is no discernable angle change between the vertical component 12 and horizontal component 14. The folded back portion 66 of the membrane in this embodiment also extends past an entire length of the member 18, and is adhered to an upper surface of the second membrane portion 36. The member configuration and disposal in this embodiment allows the horizontal component 14 to move in a direction of the arrow 76 in the folded back portion 66 of the membrane (i.e. the sealed uppermost portion of the membrane 16). This ability to move without tearing is achievable because the biasing portion 32, which is disposed at the outer portion 68 of the member 18 in this embodiment, is enveloped by the membrane 16 in such a manner that the biasing portion 32 will move away from the outer surface 70 as the horizontal component moves in the direction of the arrow 76.

Figure 10:
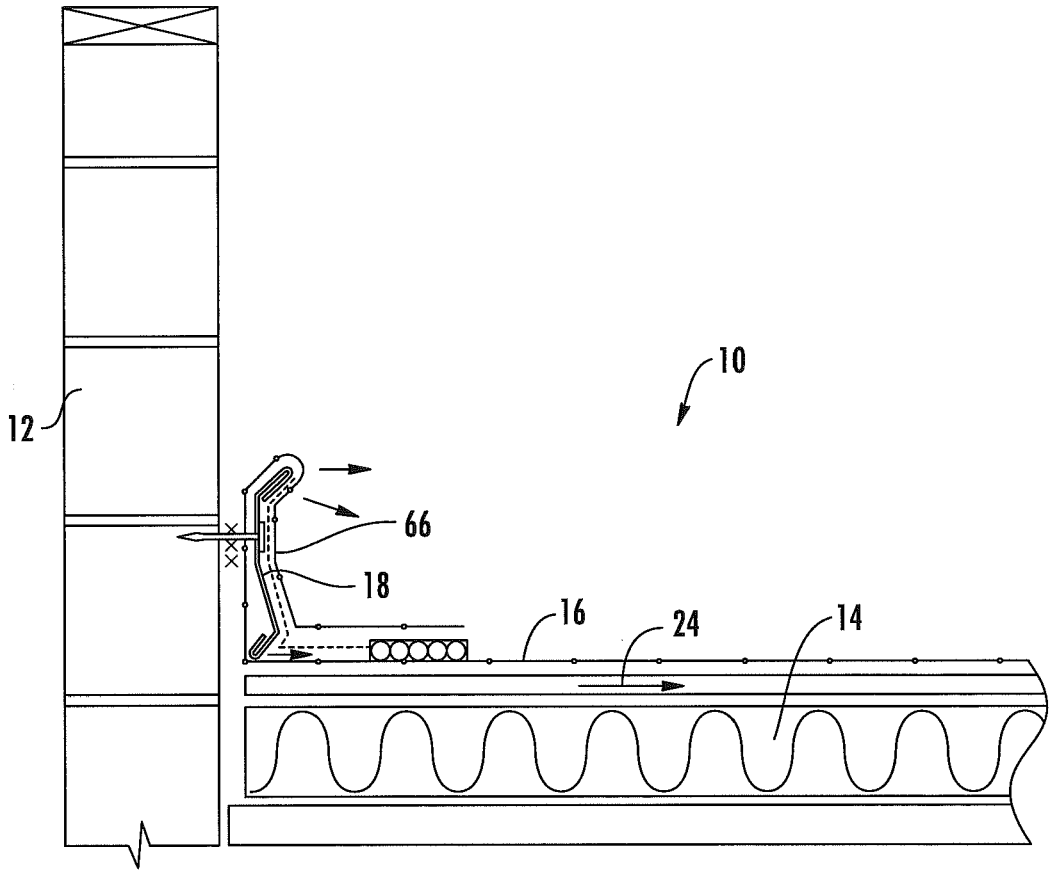
FIG. 10 is an elevated cross-sectional schematic of another embodiment of a spring flange roofing termination system.

Referring to FIG. 10, another exemplary embodiment of the system 10 is shown, wherein the member 18 is once again totally enveloped by the membrane 16. This embodiment functions similar to that of FIG. 3, but differs in that the folded back portion 66 adds another layer of membrane that may be pulled at the relatively upper end of the member 18 (via movement of the horizontal component 14 in the direction of the arrow 24) without tearing.

Figure 11:
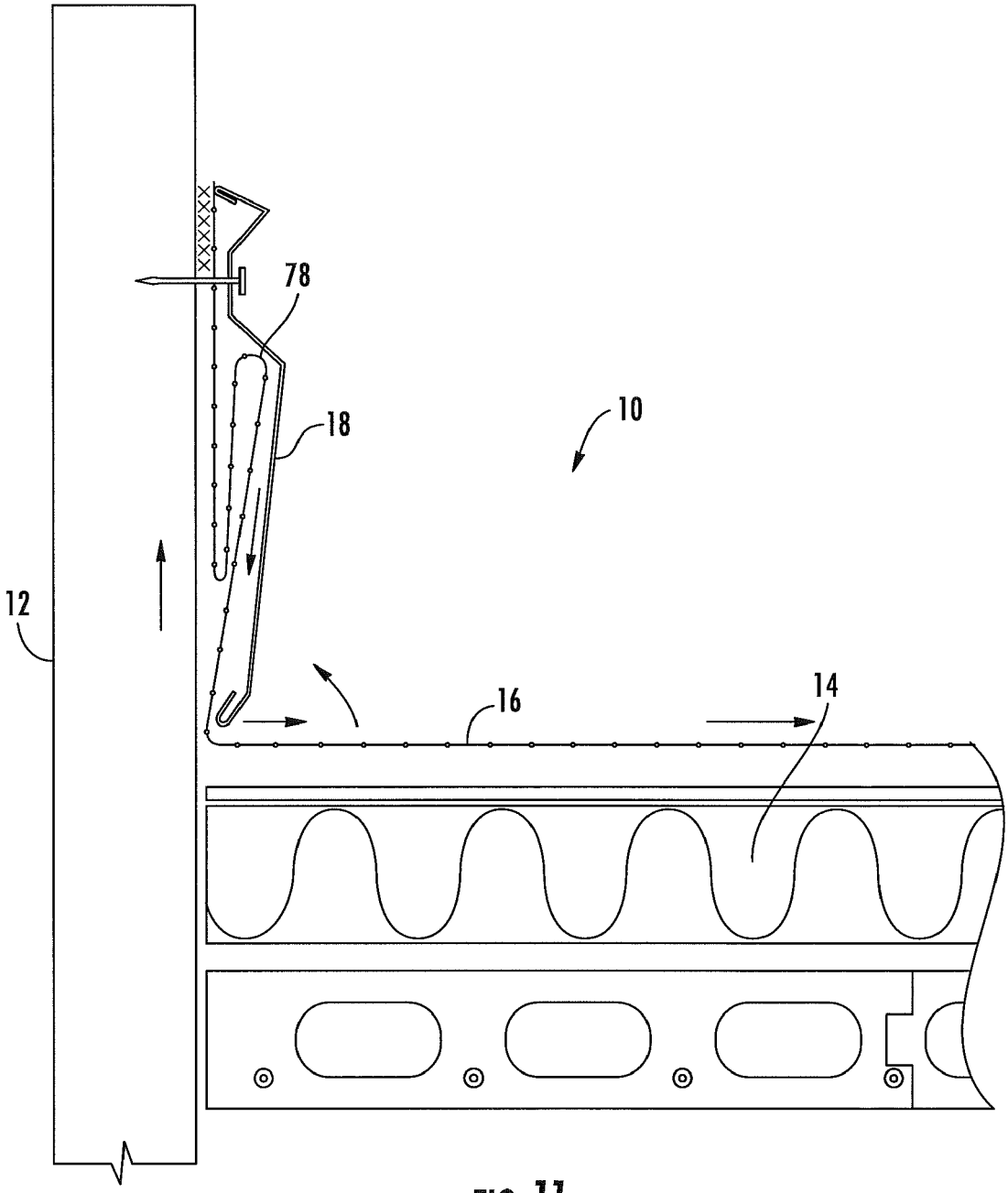
FIG. 11 is an elevated cross-sectional schematic of another embodiment of a spring flange roofing termination system.

Referring now to FIG. 11, another exemplary embodiment of the system 10 is shown, wherein the membrane 16 includes an excess portion 78 that is folded up under the member 18 (i.e. between the member 18 and vertical component 12) "ribbon candy" style. This embodiment functions similar to that of FIG. 3, but differs in that the excess portion 78 is configured to be released from a position under the member 18 in response to age shrinkage of the membrane 16.

Figure 12:
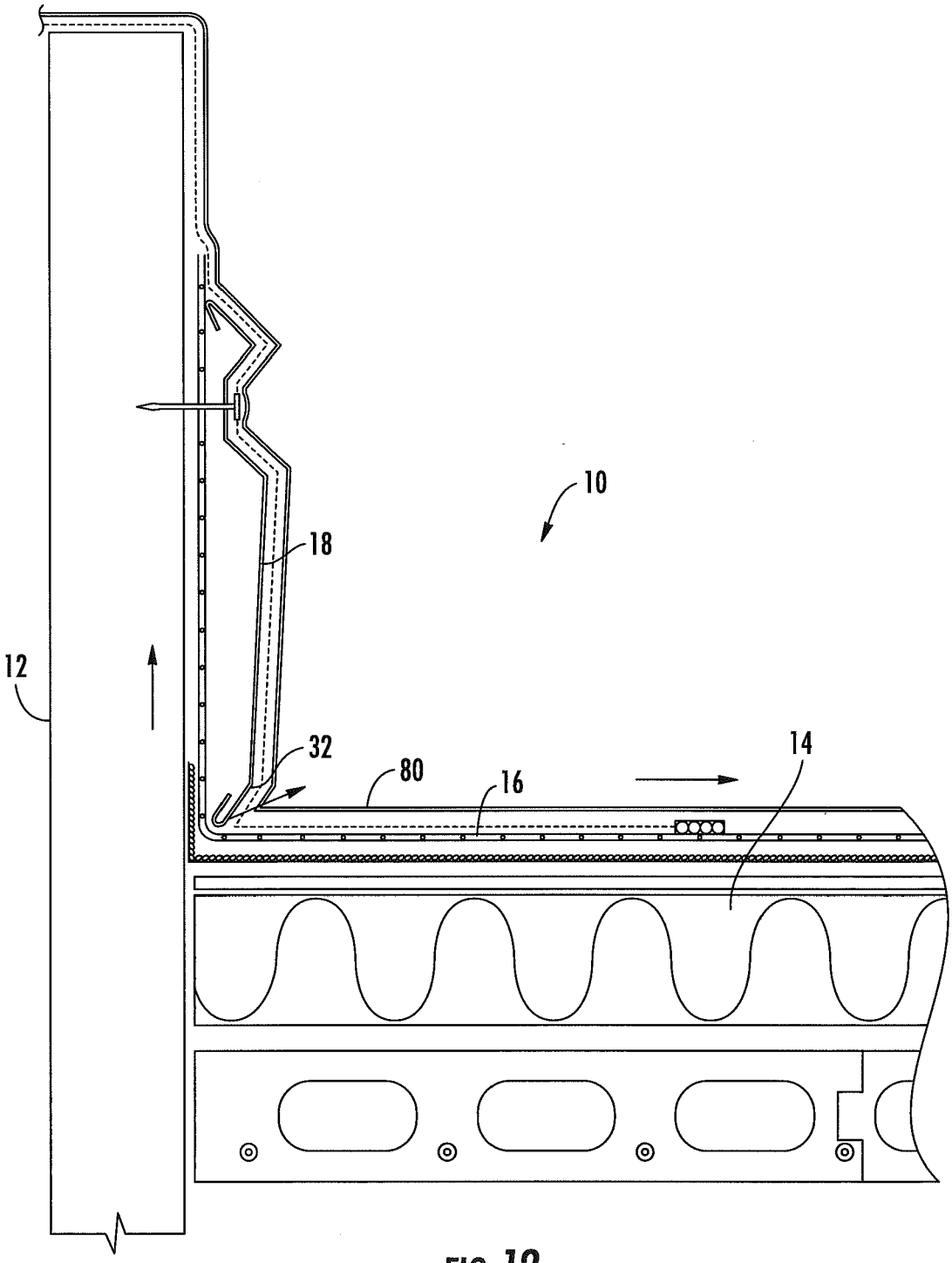
FIG. 12 is an elevated cross-sectional schematic of another embodiment of a spring flange roofing termination system.
Figure 13:
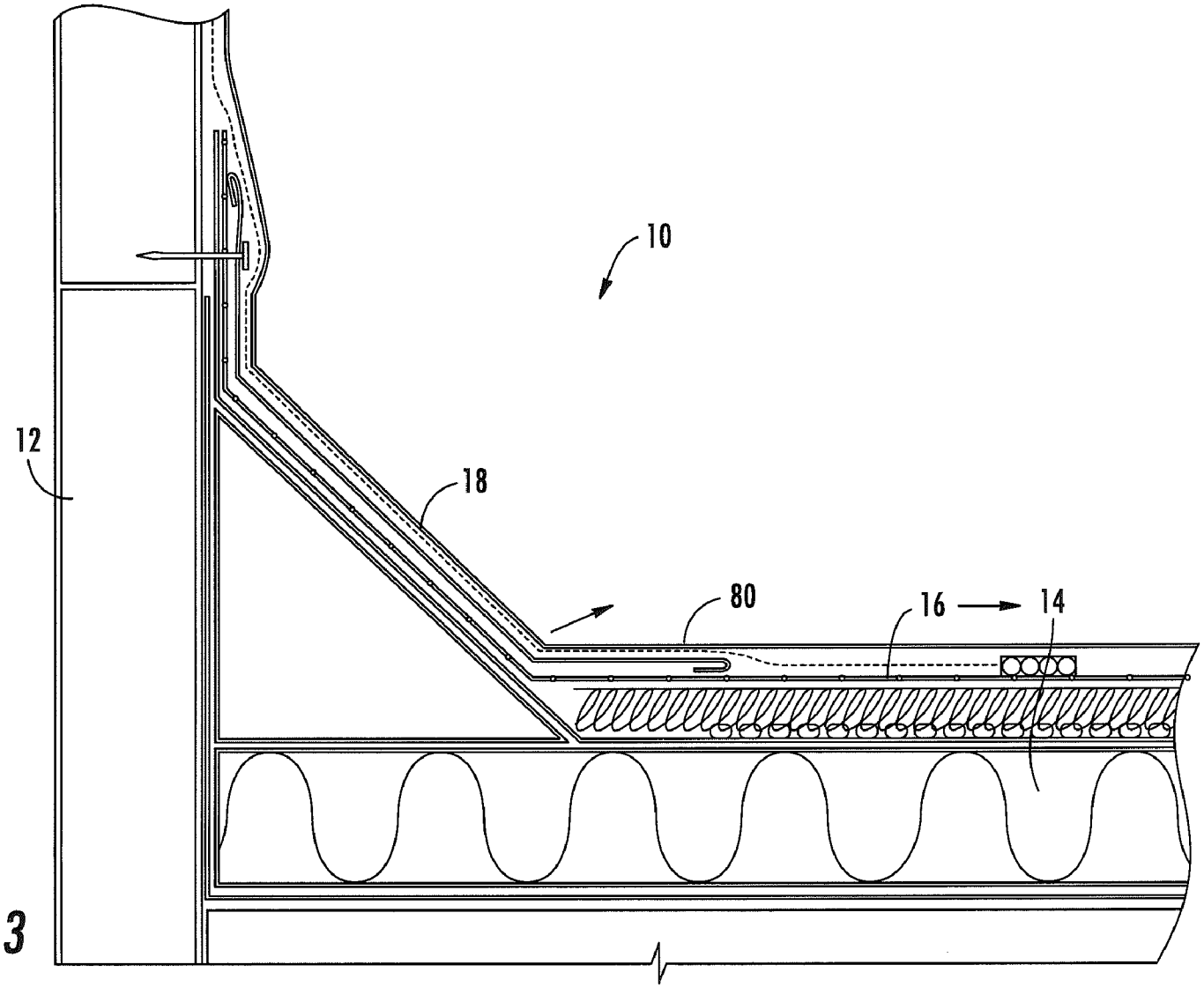
FIG. 13 is an elevated cross-sectional schematic of another embodiment of a spring flange roofing termination system.
Figure 14:
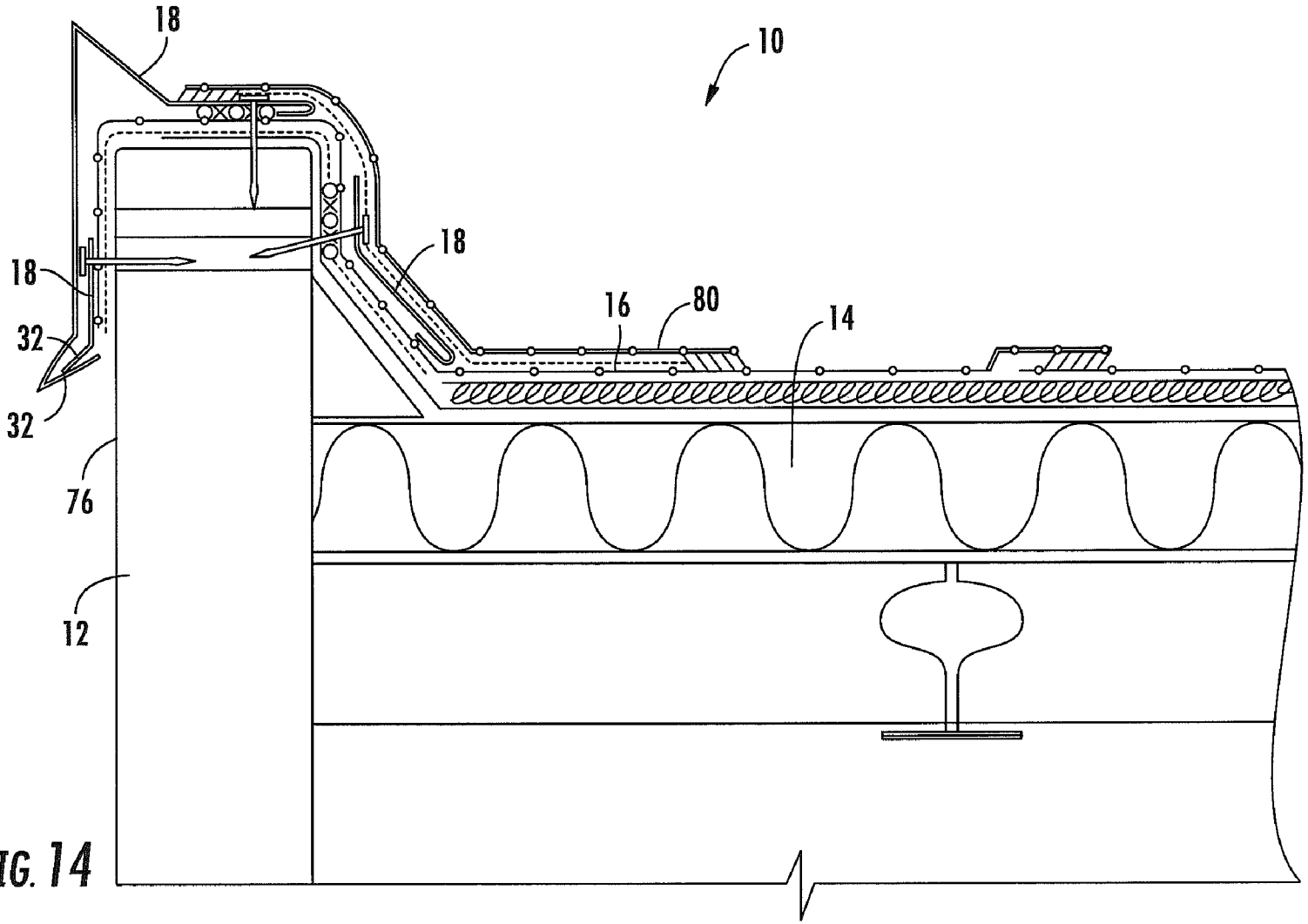
FIG. 14 is an elevated cross-sectional schematic of another embodiment of a spring flange roofing termination system.

Referring now to FIGS. 12 and 13, another exemplary embodiment of the system 10 is shown, wherein a second roofing membrane 80 is affixed (adhered in this embodiment) to the member 18 and/or membrane 16. In this exemplary embodiment, the second roofing membrane 80 is a field waterproofing membrane, which aids in anchoring the membrane 16 to the vertical component 12. Referring in particular to FIG. 13, the membrane 16 may be a sheer skirt. FIG. 14 similarly illustrates the above discussed second membrane 80, but also illustrates a three member embodiment of the system 10, wherein the biasing portion 32 of one of the members 18 interacts with the biasing portion 32 of another of the members 18 along the outer surface 76 of the vertical component 12.

Figure 15:
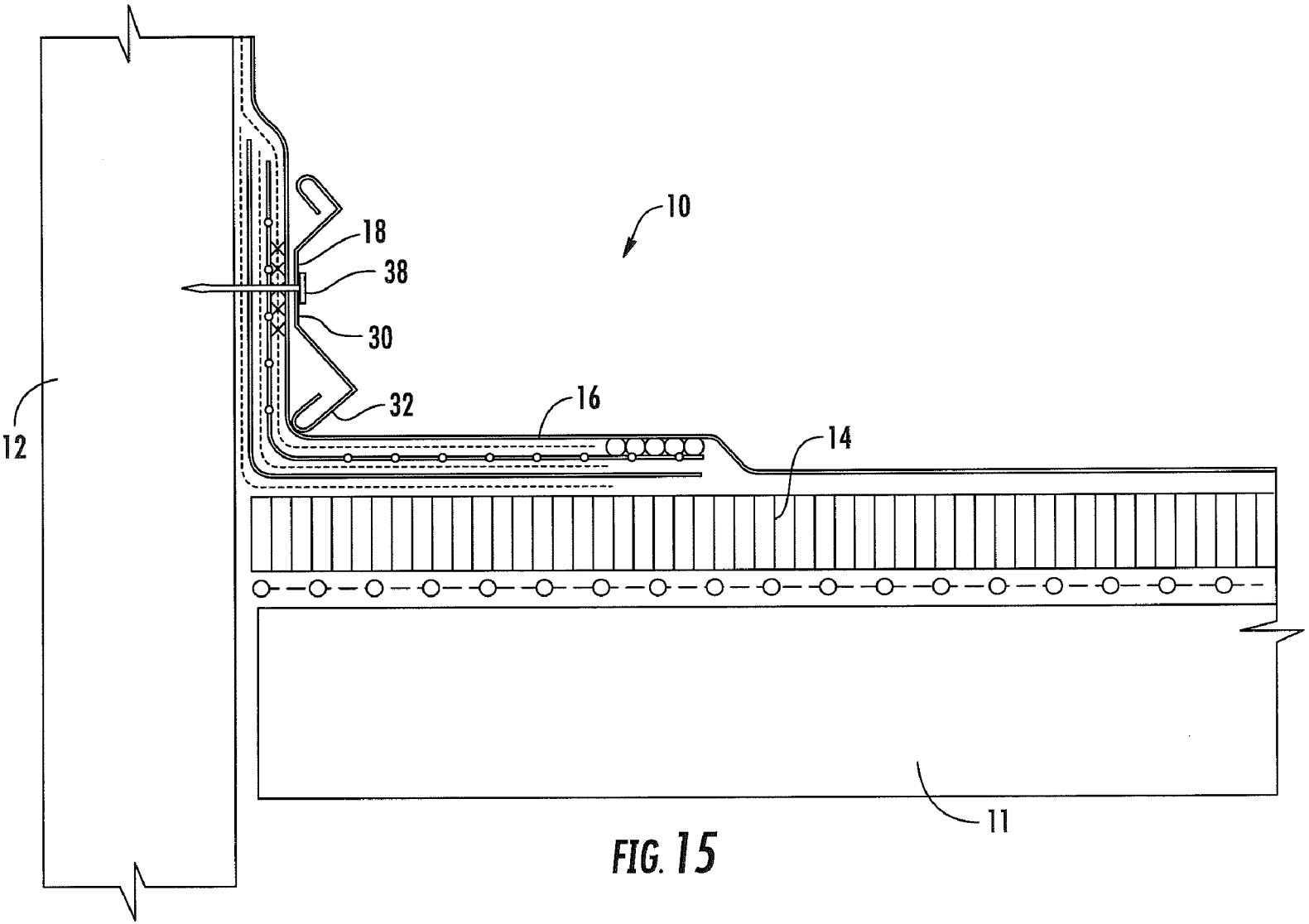
FIG. 15 is an elevated cross-sectional schematic of another embodiment of a spring flange roofing termination system.
Figure 16:
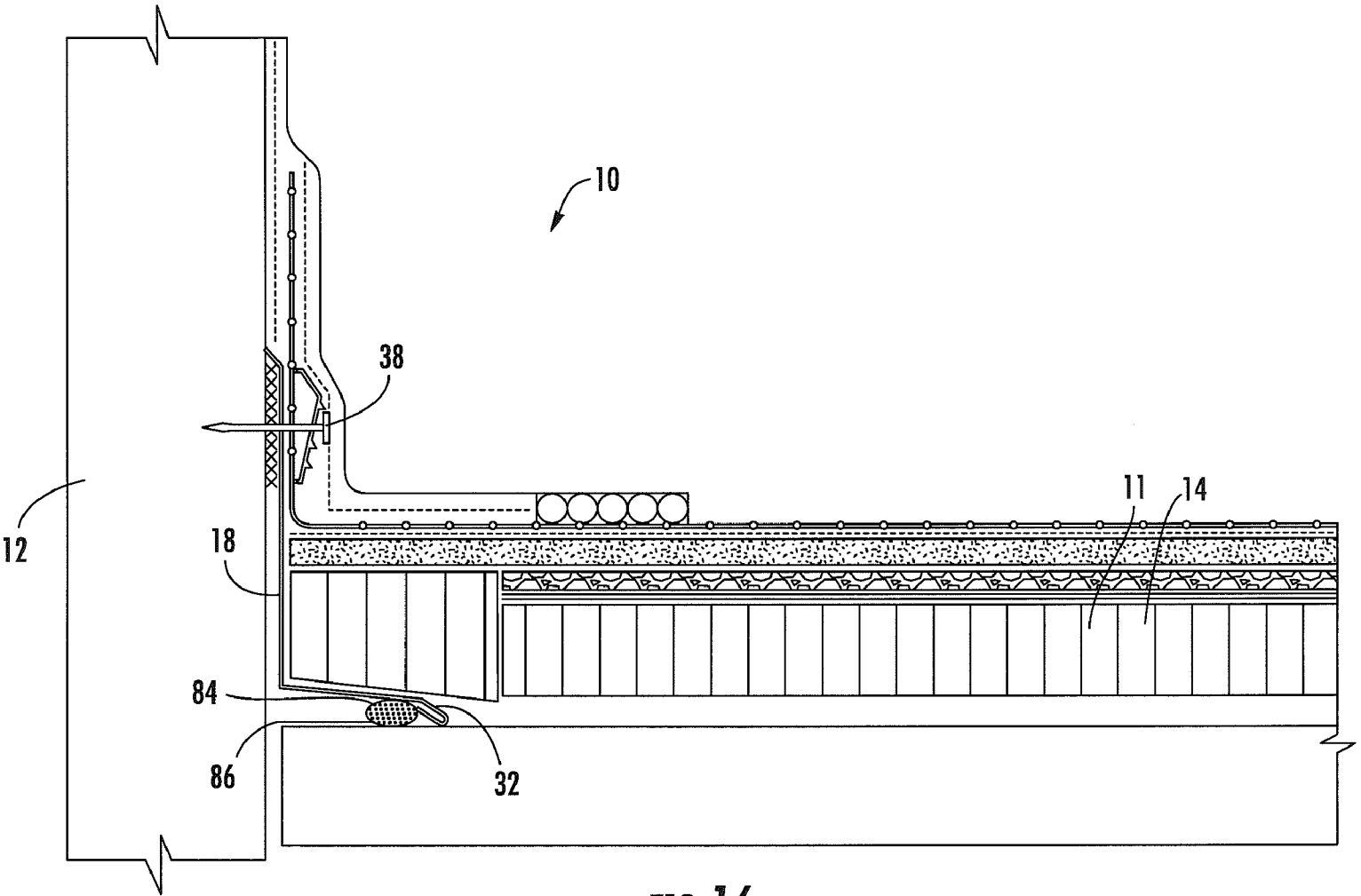
FIG. 16 is an elevated cross-sectional schematic of another embodiment of a spring flange roofing termination system.

As is shown in the exemplary embodiment of FIG. 15, the anchoring portion 30 of the member 18 and fastener 38 may be disposed anywhere along the body of the member 18 that is desirable (such as a near midpoint as shown in FIG. 15). In addition, as is shown in the exemplary embodiment of FIG. 16, the member 18 may be used to aid in air sealing the roof deck 11. In this embodiment, a sealing material 84 is disposed between the horizontal roof component 14, which is the roof deck 11, and the biasing portion 32 of the member 18. As is discussed with reference to bias upon the membrane 16 above, the biasing portion 32 thus creates a bias that presses the sealing material 84 into contact with the non-fastenable roof deck 11, creating an interior deck seal 86. As is also shown in the exemplary embodiment of FIG. 16, a roof assembly may be disposed upwardly adjacent of the roof deck 11.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A spring flange termination system comprising:

a spring flange member of a resilient material, said spring flange member including an anchoring portion and a biasing portion;

a first roof component to which said anchoring portion of said spring flange member is anchored;

a second roof component proximate said first roof component, said second roof component being moveable in relation to said first roof component; and a roofing membrane including a first membrane portion and second membrane portion, said first membrane portion being anchored to said first roof component and said second membrane portion being loose laid over at least one of said first roof component and said second roof component, wherein said first membrane portion is disposed between said spring flange member and said first roof component such that said anchoring portion of said spring flange member anchors said first membrane portion to said first roof component, said anchoring portion being substantially flat and running substantially parallel to said first roof component, said spring flange member and said first membrane portion being anchored to said first roof component via a mechanical fastener disposed through said substantially flat anchoring portion, said first membrane portion, and said first roof component, wherein said biasing portion of said spring flange member biases said second membrane portion towards contact with at least one of said first roof component and said second roof component via direct contact between said biasing portion and said second membrane portion, and wherein said substantially flat anchoring portion is disposed between two opposing ends of said spring flange member, each of said opposing ends and said substantially flat anchoring portion being in contact with said roofing membrane such that said spring flange member is in contact with and said roofing membrane at at least three distinct points.

2. The system of claim 1, wherein said biasing portion is further configured such that said bias is overcome by movement of said second roof component in at least one direction relative to said first roof component, said movement causing said second membrane portion to move away from contact with at least one of said first roof component and said second roof component.

3. The system of claim 1, wherein said first roof component and said second roof component abut each other at an area of angle change between said first roof component and said second roof component.

4. The system of claim 3, wherein said first roof component is positioned relative to said second roof component such that said anchoring portion is anchored to said first roof membrane at an anchoring point disposed relatively above said second roof component.

5. The system of claim 4, wherein said anchoring point is disposed at least three inches above said second roof component, and no more than eight inches above said second roof component.

6. The system of claim 1, further including a second roofing membrane that is fixed to said spring flange member.

7. The system of claim 6, wherein said movement of said second roof component in relation to said first roof component causes said second roof membrane to move away from at least one of said first roof component and said second roof component with said biasing portion.

8. The system of claim 1 wherein at least one end of said spring flange member is configured to prevent tearing of said roofing membrane in contact with said at least one end.

9. The system of claim 8, wherein at least one of the first membrane portion and second membrane portion includes a folded back portion that is folded back upon itself over said at least one end of the spring flange member, said folded back portion being adhered to an upper surface of said roofing membrane.

10. The system of claim 1, wherein said resilient material is at least one of sheet metal, polymer coated sheet metal, and plastic.

11. The system of claim 1, wherein said spring flange member includes a first stiffening bend at an end of said spring flange member proximate an anchoring point where said spring flange member is anchored, and wherein said spring flange member includes a second stiffening bend at an end said spring flange member proximate a biasing point where said spring flange member biases said second membrane portion.

12. The system of claim 1, wherein said first roof component is moveable in a substantially vertical plane relative to said second roof component, and wherein said second roof component is moveable in a substantially horizontal plane relative to said first roof component.

13. The system of claim 1, wherein said roofing membrane includes excess membrane material folded under said spring flange member, said excess material being configured to be released from a position under said spring flange member in response to age shrinkage of said roofing membrane.

14. The system of claim 1, wherein one of said opposing ends is proximate said biasing portion.

* * * * *